US005513472A

United States Patent [19]

Olsen et al.

[11] Patent Number: 5,513,472

[45] Date of Patent: May 7, 1996

[54] FOOT GRILLES

[75] Inventors: Robert W. Olsen, Washington, N.J.; William Vincent, Georgetown, Canada

[73] Assignee: Construction Specialties, Inc., Cranford, N.J.

[21] Appl. No.: 340,035

[22] Filed: Nov. 14, 1994

[51] Int. Cl.[6] ..... E04C 1/30

[52] U.S. Cl. ..... 52/177; 52/181; 52/71; 52/588.1

[58] Field of Search ..... 52/177, 181, 588.1, 52/71

[56] References Cited

U.S. PATENT DOCUMENTS

| | | | |
|---|---|---|---|
| 2,181,812 | 11/1939 | Kammerer . | |
| 2,680,698 | 6/1954 | Schnee . | |
| 3,039,575 | 6/1962 | Graham . | |
| 3,043,407 | 7/1962 | Marryatt | 52/177 X |
| 3,046,852 | 7/1962 | Graham | 52/177 X |
| 3,301,147 | 1/1967 | Clayton et al. | 52/588.1 X |
| 3,555,762 | 1/1971 | Contanzo, Jr. | 52/177 X |
| 3,572,224 | 3/1971 | Perry | 52/588.1 X |
| 3,783,471 | 1/1974 | McGeary et al. . | |
| 3,808,628 | 5/1974 | Betts . | |
| 4,029,834 | 6/1977 | Bartlett . | |
| 4,126,006 | 11/1978 | Lewis | 52/177 X |
| 4,381,324 | 4/1983 | Ellingson, Jr. . | |
| 4,568,587 | 2/1986 | Balzer . | |
| 4,654,245 | 3/1987 | Balzer et al. . | |
| 4,663,903 | 5/1987 | Ellingson, Jr. . | |
| 4,675,222 | 6/1987 | Berndt, Jr. . | |
| 4,766,020 | 8/1988 | Ellingson, Jr. . | |
| 4,804,570 | 2/1989 | Bedics . | |
| 4,877,672 | 10/1989 | Shreiner | 52/71 X |
| 4,879,151 | 11/1989 | Ellingson, Jr. . | |
| 5,009,045 | 4/1991 | Yoder | 52/181 X |
| 5,054,253 | 10/1991 | Bedics | 52/181 X |
| 5,205,092 | 4/1993 | Taylor | 52/181 X |

*Primary Examiner*—Wynn E. Wood

*Attorney, Agent, or Firm*—Brumbaugh, Graves, Donohue & Raymond

[57] ABSTRACT

A foot grille comprises a multiplicity of elongated plank members, each being of substantially uniform cross-section along its length and including a substantially planar base portion having parallel side edges and at least two supporting leg portions depending from the base portion, extending longitudinally substantially coextensively with the base portion, and being adapted to support the base portion in spaced relation above a supporting surface. Tread members are attached to the upper surface of each plank member. A snap-fit coupling joins each adjacent pair of plank members along a juncture between their adjacent side edges. Each snap-fit coupling includes first and second arm portions on one of the adjacent plank members that are resiliently deformable relative to each other and a third arm portion on the other of the adjacent plank members that is received between the first and second arm portions of said one plank member. The first and third arm portions have a first inter-engaging tongue and groove pair, and the second and third arm portions have a second inter-engaging tongue and groove pair.

17 Claims, 6 Drawing Sheets

FOOT GRILLES

BACKGROUND OF THE INVENTION

It is common practice in commercial and industrial buildings, schools, hospitals, and the like to provide at the public entrances foot mats or grilles for removing dirt from the footwear of persons entering the building. One type of foot grille that is widely used is one that has elongated, narrow individual tread rails of generally T-shaped cross-section joined together with spaces between them through which dirt and water removed by the tread rails can pass to a surface below the grille. The tread rails are joined together by connecting bars that extend transversely through triangular holes in the vertical web portions of the tread rails. Such grilles are assembled by placing the tread rails in a jig, inserting the connecting bars through the holes in a laterally tilted position, and pivoting the connecting bars one by one to an upright position using a special pneumatically powered tool. A foot grille of that type is described and shown in U.S. Pat. No. 4,112,640 (Reifsnyder, 1978).

Another type of known foot grille is composed of elongated, narrow tread rails that are joined by integral tongue and groove hinges or individual coupling strips of "dog-bone" cross-section so that the grille, which might better be termed a mat, can be rolled up when it is removed for cleaning the surface below it. Foot mats of this type can be placed directly on a floor or set into a shallow recess in the floor so that the tread surfaces of the rails are flush with the adjacent floor. They are assembled by sliding the rails and the coupling strips, where included, endwise one by one. Examples of foot mats of the hinged, roll-up type are found in U.S. Pats. Nos. 4,029,834 (Bartlett, 1977) and 5,157,804 (Williams, 1992).

Foot grilles and mats of the type disclosed in the above-mentioned patents provide superior performance in use. They are attractive and durable, can be fitted with various tread surfaces, and effectively remove dirt and water from the footwear of persons walking across them. The dirt and water fall or are scraped into the spaces between the tread rails of grilles or through holes in the tread rails of mats onto a surface on which the grille or mat rests. Foot grilles are often installed in a pit that has a drain, and periodically the grille and drain are hosed down to remove accumulated dirt, which drains away. Alternatively, the grille is removed from the pit to enable the pit to be cleaned out. Foot mats can be rolled up to permit the space underneath them to be cleaned thoroughly. Routine cleaning of mats can be done effectively with a commercial vacuum cleaner.

Foot mats and grilles of the type described have some disadvantages. They are relatively difficult to assemble, assembly requires special jigs and tools, and the labor required for assembly is costly. Also, the grille or mat has to be shipped in assembled condition, which usually requires a cumbersome and large shipping configuration.

SUMMARY OF THE INVENTION

One object of the present invention is to provide a foot grille that can be assembled easily and quickly. Another object is to provide a foot grille that can be assembled without any tools. It is also desired to retain all of the advantages of previously known foot grilles.

The foregoing objects are attained, in accordance with the present invention, by a foot grille comprising a multiplicity of elongated plank members, each plank member being of substantially uniform cross-section along its length and including a substantially planar base portion having parallel side edges and at least two supporting leg portions depending from the base portion, extending longitudinally substantially coextensively with the base portion, and being adapted to support the base portion in spaced relation above a supporting surface. Tread members are attached to the upper surface of each plank member. Snap-fit couplings join each adjacent pair of plank members along a juncture between their adjacent side edges. Each snap-fit coupling includes integral first and second arm portions on one of the adjacent plank members that are resiliently deformable relative to each other and a third arm portion carried by the other of the adjacent plank members that is received between the first and second arm portions of said one plank member. The first and third arm portions have a first inter-engaging tongue and groove pair, and the second and third arm portions have a second interengaging tongue and groove pair.

The snap-fit couplings between adjacent plank members permit the foot grille to be assembled quickly and easily without any tools. Advantageously, the plank members for a grille can be shipped to the job site and assembled on the job. Shipping a grille in disassembled condition permits the parts to be nested and shipped in a smaller and less cumbersome container than is required for the assembled grille. The smaller container is more easily stored on the job, and assembly of the grille can be delayed until an optimum time.

In all embodiments, the first arm of each snap-fit coupling is a band adjacent one edge of the base portion of one of the adjacent plank members, and the second arm is located below the first arm and is joined to the base portion along a juncture spaced apart from the side edge of the member. The first and second arms are integral with the plank member and, preferably, extend continuously along the length of the plank member. In some embodiments, the third arm is integral with the other of the adjoining plank members and extends outwardly from an edge of the base portion of the other one of the adjacent members. As described below, the third arm may be a portion of a clip member.

In the case of a grille that is to be installed in a pit, one of the supporting leg portions is joined to the second arm portion of the snap-fit coupling in spaced apart relation to the juncture and includes a web portion dependant from the second arm portion and a foot portion on its lower end. For a grille that is to be placed in a shallow blocked-out recess in a floor, one of the supporting leg portions is coincident with a part of the second arm portion and includes a foot portion on its lower end.

Each plank member, preferably, has on the upper surface of the web portion a multiplicity of longitudinally extending laterally spaced-apart ribs arranged in pairs, each rib pair defining a receptacle or channel. Each channel receives a tread member in the form of an elongated strip. The channels are closely spaced apart, and holes, which are, however, optional, in the web portion between the channels allow dirt and water to pass from above the grille through it to the supporting surface.

As mentioned above, the third arm portion in some embodiments is integral with and extends substantially continuously along the length of one of the adjacent plank members. Alternatively, the snap fit couplings joining at least two adjacent plank members of a grille (or any number, including all, of the adjacent pairs of plank members) may be composed of long clip members, which may or may not have perforations for dirt and water to pass through, or a multiplicity of short clip members spaced apart longitudinally at intervals along the lengths of the adjacent plank members. The clip member has a third arm portion that is received between first and second arm portions of each of the adjacent plank members. In other words, each of the adjacent plank members that are joined by clip members has the resilient first and second arms at the juncture, and each clip member has two third arm portions, one received between the first and second arms of each of the adjacent plank members. Each clip member may be substantially rigid, or it may have a flexible portion joining the third arm portions. Clips with flexible portions allow the grille or mat to readily conform to irregular surfaces.

For a better understanding of the invention, reference may be made to the following description of an exemplary embodiment, taken in conjunction with the accompanying drawings.

DESCRIPTION OF THE EMBODIMENTS

Figure 1:
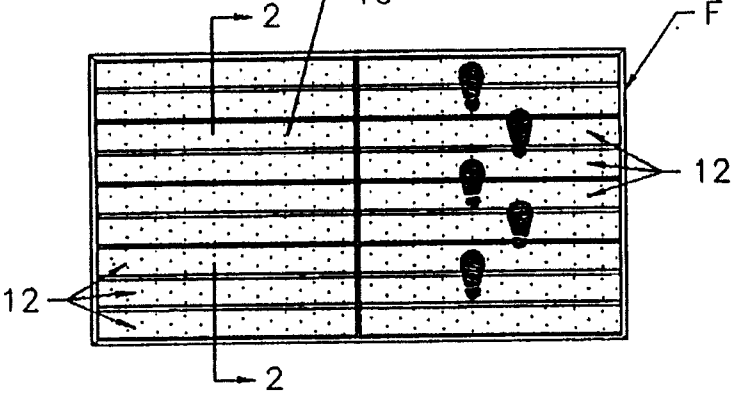
FIG. 1 is a top plan view of a foot grille embodying the present invention shown as installed in a pit.
Figure 2:
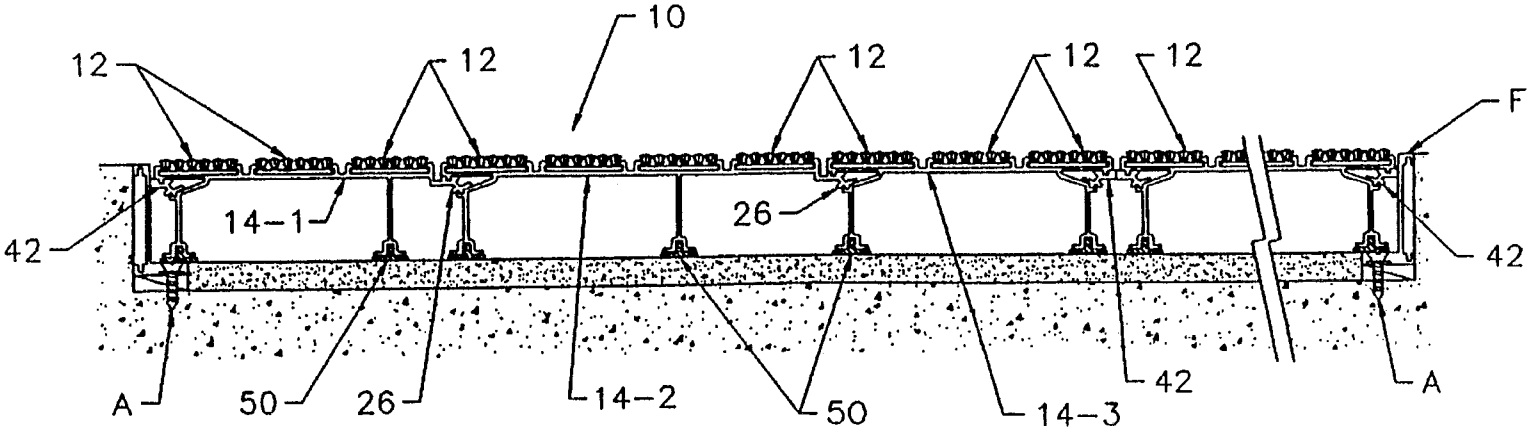
FIG. 2 is an end cross-sectional view of the grille installation shown in FIG. 1, as indicated by the lines 2—2 of FIG. 1.

As is well-known per se and as illustrated in FIGS. 1 and 2, foot grilles are often installed in special pits in the floor at a building entry way. A typical pit includes a peripheral frame F securely joined to the surrounding floor by masonry anchors A. In some installations, the foot grille rests directly on the floor, as shown. In other installations (not shown), the pit has a bottom pan that is joined to the frame, fills the bottom of the opening formed by the frame, and has a drain, and cross support members extending between opposite sides the frame support the foot grille. The foot grille 10 has a tread surface composed of elongated, narrow tread members 12 extending widthwise of the pit in closely spaced, parallel relation. The tread members remove dirt and water from the footwear of persons entering the building. As shown in FIG. 1, the foot grille is installed such that the normal path of persons walking across it is transverse to the tread members. The dirt and water are scraped from the footwear into the recessed spaces between the tread members and fall through holes in the foot grille (described below) onto the floor or pan.

The embodiment of the present invention shown in FIGS. 2 to 13 is constructed for installation in a pit of the type shown in FIG. 1 or a pit with a pan and drain (not shown). It is characterized by relatively tall supporting legs, which provide the strength and stiffness required to enable it to be supported at intervals by the frame F and cross support members, where provided.

As shown in FIG. 2, the foot grille 10 comprises a multiplicity of elongated plank members 14-1, 14-2, and 14-3, each of which is of substantially uniform cross-section along its length and includes a substantially planar base portion 16 (see FIGS. 4 to 6) having parallel side edges 18 and 20 and at least two supporting leg portions 22 and 24 depending from the base portion, extending longitudinally substantially coextensively with the base portion, and being adapted to support the base portion in spaced relation above a supporting surface. The plank members are fabricated by cutting pieces of the desired length from metal extrusions, aluminum being the preferred material. Alternatively, the plank members can be made from a composite material, such as a fiber-reinforced polymeric material. The tread members 12 are attached to the upper surface of the base portion of each plank member.

A snap-fit coupling 26 joins each adjacent pair of plank members 14 along a juncture between their adjacent side edges. Each snap-fit coupling 26 (see FIGS. 10 and 11) includes first and second arm portions 28 and 30 on one of the adjacent plank members that are resiliently deformable relative to each other and a third arm portion 32 on the other of the adjacent plank members that is received between the first and second arm portions 28 and 30. The first and third arm portions 28 and 32 have a first inter-engaging tongue and groove pair 34, 36, and the second and third arm portions 30 and 32 have a second inter-engaging tongue and groove pair 38, 40.

FIG. 2 shows some of the variations of a foot grille embodying the present invention. One variation is that a plank member 14-1 or 14-2 may have the first and second arms 28 and 30 of the snap-fit coupling along one edge and the third arm 32 along its opposite edge, or a plank member 14-3 may have the first and second arms 28 and 30 along both edges. Another form of plank member (not shown) may have the third arms 32 along both edges.

Figure 3:
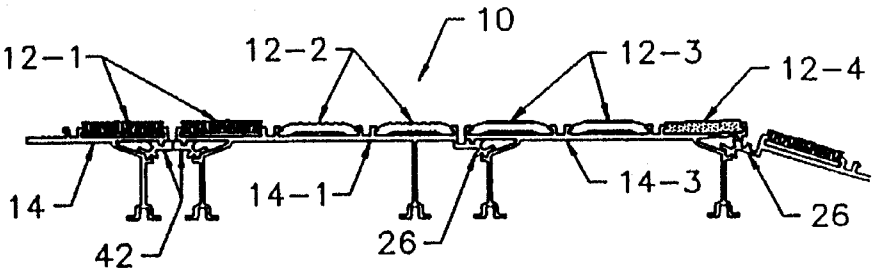
FIG. 3 is an end view of the foot grille shown in FIG. 1 and shows different tread members installed on different plank members.

Another variation in the grille, which is shown in Fig. 3, is the form of tread member 12. The foot grille of the present invention has plank members that are configured to accept, interchangeably, tread members in the form of strips of carpet (12-1), strips of a polymeric material (12-2) having an embossed, slip-free surface, strips of a polymeric material having a layer of an abrasive material bonded to the upper surface (12-3), or strips composed of an abrasive material bound by a binder and deposited and cured in situ in the channels (12-4). Generally, any given grille will include tread members of one type, but sometimes different portions or sections of a grille installation may have different type tread members. In yet another variation in the grille (not shown), the tread members are integral with the plank members and are in the form of raised portions on the upper surfaces of the plank members.

Figure 19:
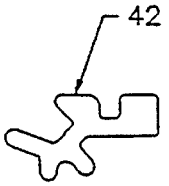
FIG. 19 is an end view of a spacer useful in the foot grilles of the present invention.
Figure 10:
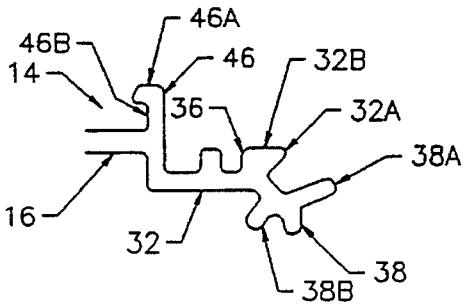
FIGS. 10 and 11 are fragmentary detail end views of the portions of the plank members that form the snap-fit couplings between adjacent plank members.

To facilitate handling at assembly and initial installation, and removal and handling from time to time, such as for thorough cleaning, a large foot grille installation may include two or more separate grille sections, each of a convenient size, placed side by side in a single pit or floor recess. In such a case, the adjacent grille sections will be held at the desired edge to edge spacing from each other by spacer blocks 42 (FIG. 19) that snap on to the first and second arms 28 and 30 of adjacent planks at intervals along the lengths of the abutting grille sections, as shown at the right side of FIG. 2 and the left side of FIG. 3. The spacer blocks 42 are also used along the edges of the plank members that abut the frame (see Fig. 2). Instead of spacer blocks, plank members (not shown) designed to abut each other or the frame can be used.

Figure 4:
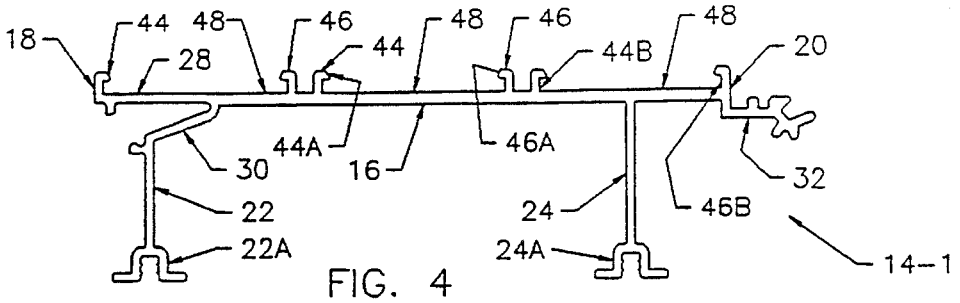
FIG. 4 is an end elevational view of a plank member of the embodiment of FIGS. 1 and 2.

Referring to FIG. 4, each plank member 14 has on the upper surface of its base portion a multiplicity of ribs 44, 46, which are arranged in pairs such as to define closely spaced side by side channels 48, each of which receives a tread member. Each rib has a lip 44*a*, 46*a* that extends into the channel a small distance and forms an undercut groove 44*b*, 46*b* at each side of the channel. Each groove receives an edge portion of the tread member and keeps the tread member from peeling up and out of the channel along the edge. The tread members may be retained in the channels without an adhesive or fasteners, or adhesives and/or fasteners may be used, as required by the particular form of tread member. Elongated holes 16*a* (see FIGS. 7 to 9) punched through the base portion between adjacent ribs 44, 46 allow dirt and water to fall between the tread members into the pit. The holes 16*a* may, optionally, have coined end portions 16*a*' to provide increased strength for resistance to stress concentrations. The drainage holes 16*a* are desirable but are not required.

Figure 5:
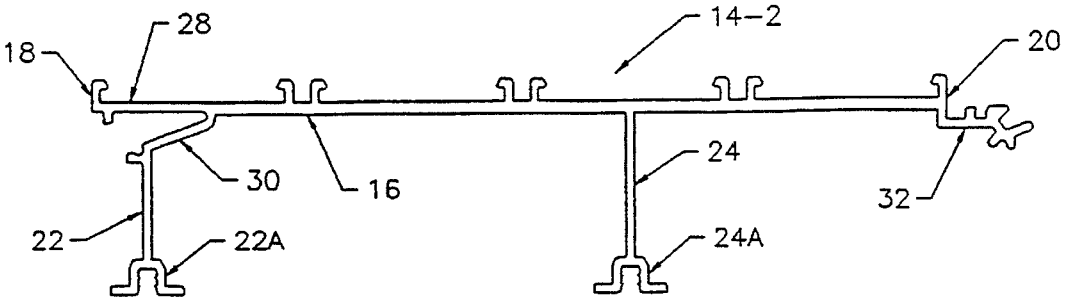
FIGS. 5 and 6 are end elevational views of other plank members useful in the embodiment of FIGS. 1 and 2.
Figure 11:
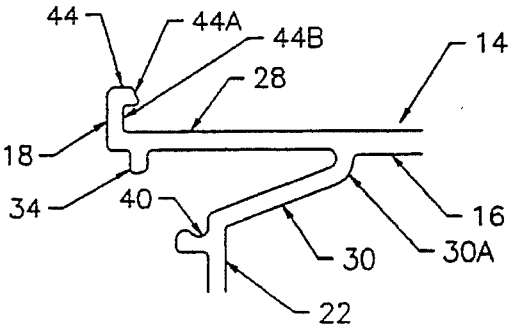
Figure 7:
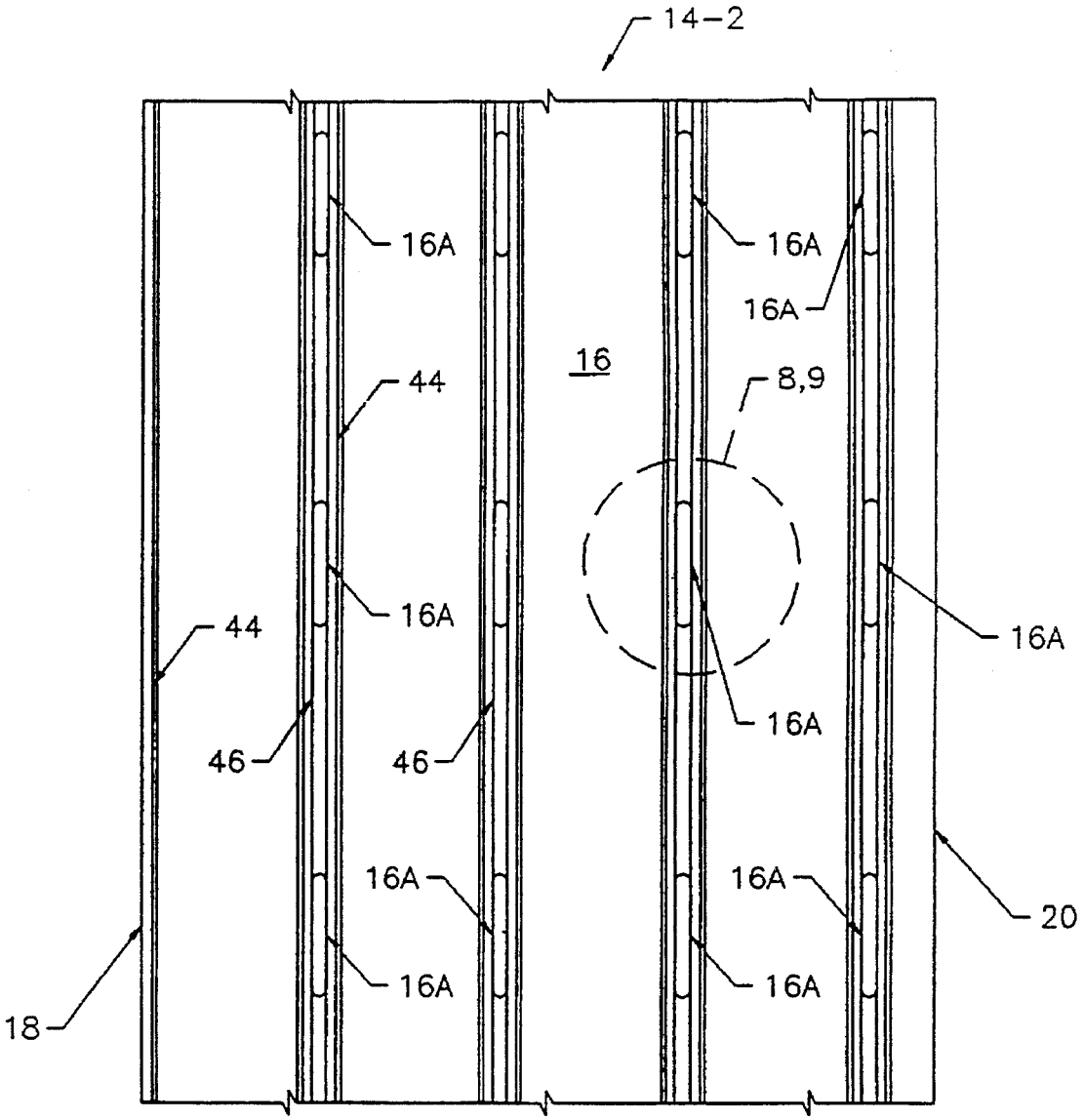
FIG. 7 is a top plan view of a segment of the plank member shown in FIG. 5.
Figure 8:
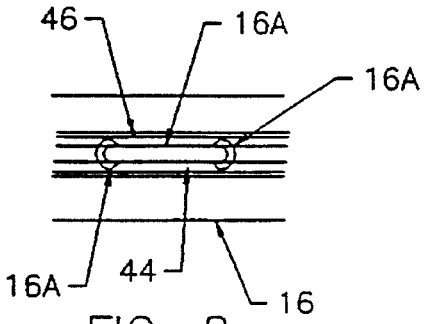
FIG. 8 is a fragmentary detail plan view of a drainage hole.
Figure 9:
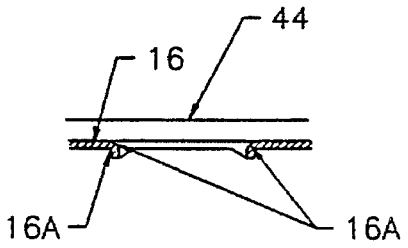
FIG. 9 is a fragmentary side cross-sectional view of a drainage hole.

The first arm portion 28 of each snap-fit coupling is a band along one edge of the base portion 16 of the plank member 14 (see FIG. 11). The second arm portion 30 extends from a juncture 30*a* with the base portion downwardly and outwardly. One leg portion 22 of the plank member extends vertically down from the end of the arm portion 30. The third arm portion 32 (see FIG. 10) of each snap-fit coupling, which is on the adjacent plank member, is offset a small distance below the base portion 16 and extends laterally outwardly so as to be received between the arm portions 28 and 30. As mentioned above, any given plank member may have the arm portions 28 and 30 along one side and the arm portion 32 along the other side, as shown in FIGS. 4 and 5. Or a given plank member may have arm portions 28 and 30 along both sides or arm portions 32 along both sides. These arrangements are entirely equivalent. One limitation, however, is that the planks that abut a frame or the planks of two grille sections that abut each other have the arm portions 28 and 30 along the abutting edge.

To enable foot grilles in a range of different dimensions crosswise of the plank members to be produced, it is suitable to combine plank members 14-1 having three channels (FIG. 3) and plank members 14-2 having four channels (FIG. 4) in various combinations. Apart from the number of channels and the overall width, the three channel and four channel plank members are the same. The plank member 14-3 (FIG. 6), which has arm portions 28 and 30 along both side edges, is used as a terminal plank member for a section that abuts another section or a frame (see FIG. 3).

Each leg 22 and 24 of each plank member has a foot portion 22*a*, 24*a* of inverted "U" shape at its lower end. Cushion members 50 (see FIG. 2) formed by cutting pieces from an extruded member are installed at intervals on each foot portion.

Figure 12:
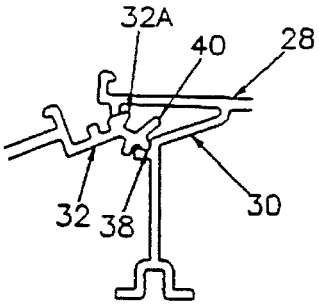
FIGS. 12 and 13 are fragmentary end views of the snap-fit couplings, showing in sequence how they are put together.
Figure 13:
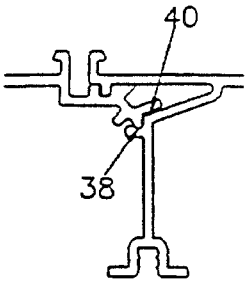
Figure 14:
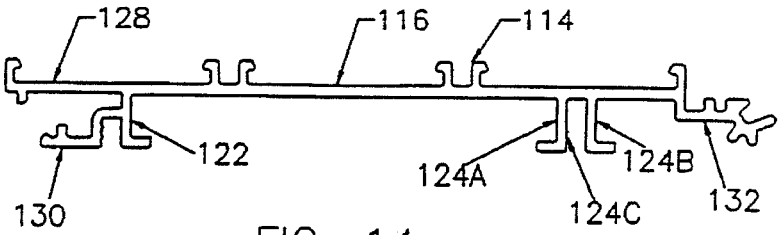
FIG. 14 is an end elevational view of a plank member for another embodiment of a foot grille according to the invention.
Figure 15:
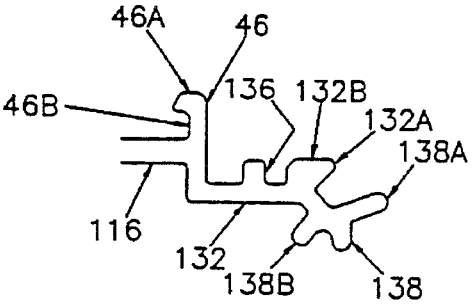
FIGS. 15 and 16 are fragmentary detail end views of the portions of the plank members that form the snap-fit couplings between adjacent plank members in the embodiment of FIG. 14.
Figure 16:
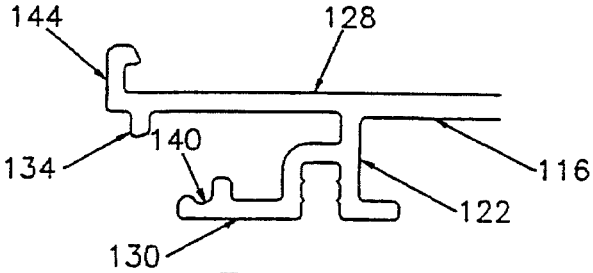
Figure 17:
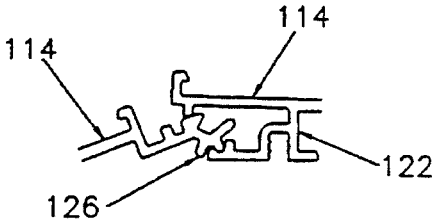
FIGS. 17 and 18 are fragmentary end views of the snap-fit couplings of the embodiment of FIGS. 14 to 16, showing in sequence how they are put together.
Figure 18:
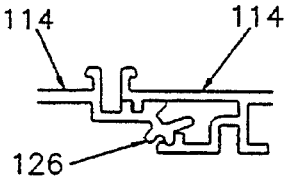

Each plank member is assembled to an adjacent plank member by first tilting one member laterally downwardly with respect to the other, as shown in FIG. 12, and seating the tongue 38 on the arm 32 of one plank member into the groove 40 on the arm 30 of the other plank member. The end of a nose portion 32*a* on the arm 32 is at a spacing from the fulcrum provided by engagement between the tongue 40 and groove 38 such as to permit the nose to enter the space between the fulcrum and the tongue 34 on the arm portion 28. Projecting rib portions 38*a* and 38*b* associated with the tongue 38 help guide the tongue 38 into the groove 40, the rib portion 38*a* being engageable with the underside of the arm portion 28 to ensure capture of the tongue 38 in the groove 40 when the plank members are oriented at a relatively large angle and the rib portion 38*b* being engageable with the extremity of the groove 40 when the plank members are oriented at a relative small angle. Now when the sections are pivoted widthwise relative to each other to bring their base portions into a coplanar relation (FIG. 13), the upper surface 32*b* of the nose portion 32*a* provides a camming or wedging action that forces the arm portions 28 and 30 to deform resiliently such that their free ends move apart, thus allowing the groove 36 to be received between the arm portions and the tongue 34 to enter the groove 36 when the arms portions 28 and 30 resile (FIG. 13). The engagement of the tongue and groove pairs on the adjacent plank members holds them together securely against lateral separation and relative pivoting. Adjacent plank members are staked or crimped together against relative movement lengthwise.

Even though the arm portions 28 and 30 are sufficiently resilient to permit the adjacent plank members to be snapped together, the regions of the base portions of the plank members above the snap-fit connections are strong and rigid with respect to the applied loads. The arm portion 32 of one plank member bridges the space between the arm portions 28 and 30 of the adjacent plank member for vertical load transfer from the base portions of the adjacent plank members to the leg portion 22.

Each plank member has a rib 44 at or closely adjacent one edge and a rib 46 closely adjacent the other edge. In the assembled grille, the ribs 44, 46 nearest each other are at the same spacing as the other ribs 44, 46 of each plank member, so the tread members maintain a regular pattern of uniform spacing throughout the grille.

The embodiment shown in FIGS. 14 to 18 is substantially the same as that of FIGS. 1 to 13. Accordingly, the corresponding components are designated by the same reference numbers as the second and third digits and with a "1" added as the first digit. The only difference is that the foot grille of FIGS. 14 to 18 has short supporting legs 122, 124, which allow it to be placed in a shallow recess blocked out in a floor. One aspect of making the legs short is the incorporation of one leg portion 122 of each plank member into the arm portion 130, rather than having the leg portion 22 depend from the end of the arm portion 30 (see FIGS. 2 to 13). The other leg portion 124 is provided by two L-shaped ribs 124*a*, 124*b*, which define a slot 124*c* between them for reception of the cushion members 50. The structure and mode of assembly of each snap-fit coupling 126 is the same as that of the embodiment of FIGS. 1 to 13, as is apparent from FIGS. 15 to 18.

The foot grille of FIGS. 14 to 18 includes the same variations as the embodiment of FIGS. 2 to 13, namely three and four tread planks (latter not shown) and planks (not shown) with arm portions 128 and 130 along both edges to enable the tread members nearest the opposite edges of the frames of the pit or recess in which the foot grille is installed to be at the same close spacing from the frame and to finish one edge of a grille section that is placed edge to edge with another grille section.

A plank member (14-3, FIG. 2) of the type having arm portions 28, 30 or 128, 130 along both edges can, of course, be placed anywhere in the grille, inasmuch as plank members having arm portions 32 or 132 along one edge and arm portions 28, 30 or 128, 130 along the other edge can be attached to its opposite sides by reversing one of them end for end.

Figure 20:
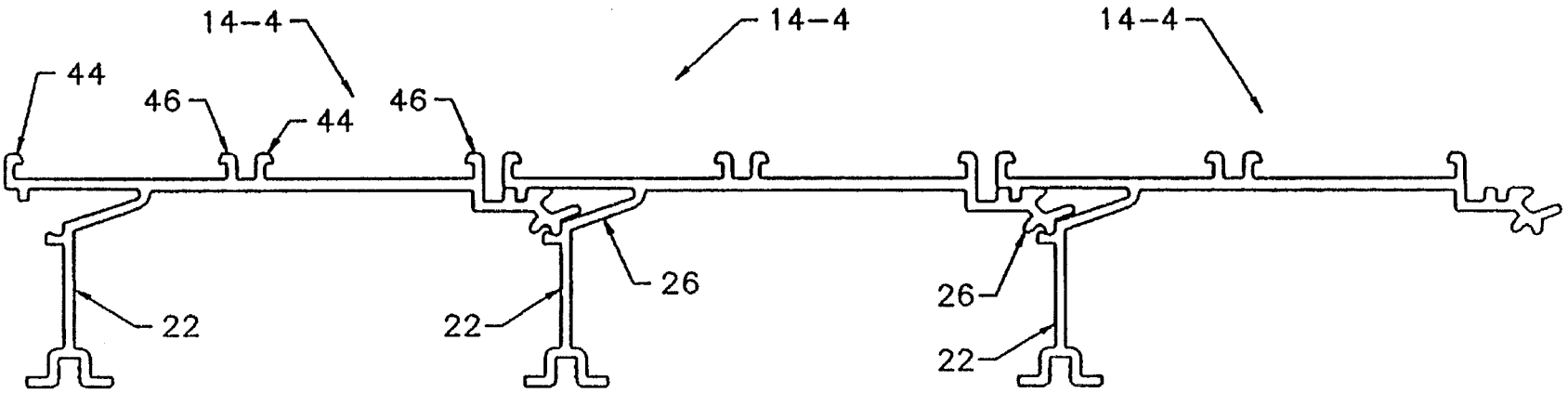
FIG. 20 is an end view of several plank members of another embodiment of a grille.

FIG. 20 shows narrow plank members 14-4, each of which has two pairs of ribs 44, 46 and only a single leg 22. The snap-fit couplings 26 are the same as those of the embodiments described above. In combinations with the other plank members of various widths, the narrow plank members 14-2 enable grilles to be made in various widths with small incremental differences between the widths. It is apparent that narrow plank members for mats can also be provided.

Figure 6:
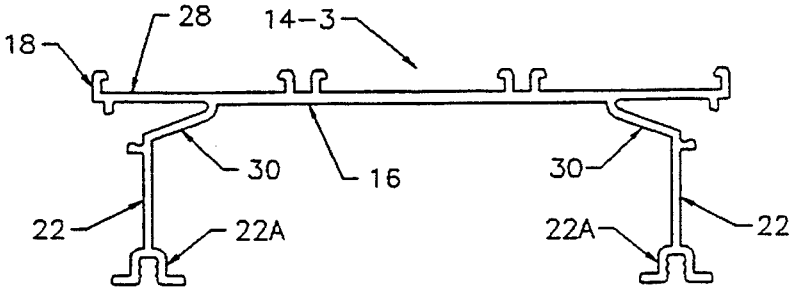
Figure 21:
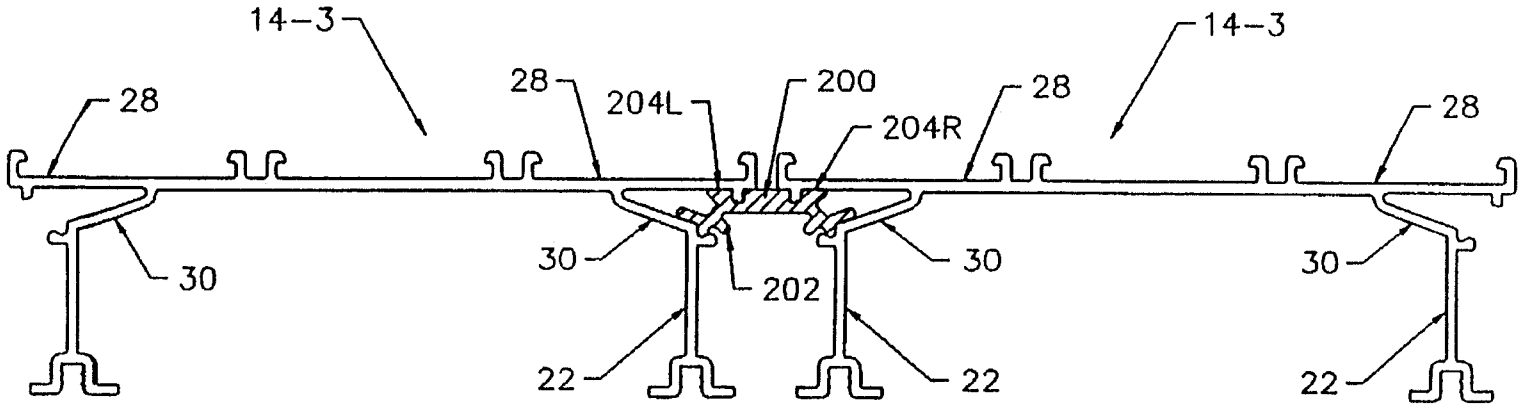
FIG. 21 is an end view of one embodiment of a grille in which the plank members are joined by clips.

As shown in FIG. 21, plank members 14-3 of the design shown in FIG. 6, which have arms 28 and 30 along both edges can be assembled into grilles using clips 200 to join adjacent plank members. The clips 200 can also be used to join any of the plank members by placing their side edges that have the first and second arms 28 and 30 adjacent each other. The clips 200 of FIG. 21 are pieces cut to a desired length, say 2 inches, from an extrusion, which may be a rigid metal or a rigid or semi-rigid polymeric material. Each clip has a center body portion 202 and a pair of arm portions 204*l* and 204*r*, each of which has a shape in cross section that is the same as the third arm portion 32 of the plank members shown in FIGS. 4 and 5. Accordingly, the respective arm portions 204*l* and 204*r* of the clips form interengaging tongue and groove pairs with each of the arms portions 28 and 30 of each of the plank members. The clips 200 can be installed at suitable intervals along the lengths of the plank members. The longitudinal spaces between the clip members allow dirt and water to pass through the grille onto the floor below the grille and enable the drain holes to be eliminated.

Figure 22:
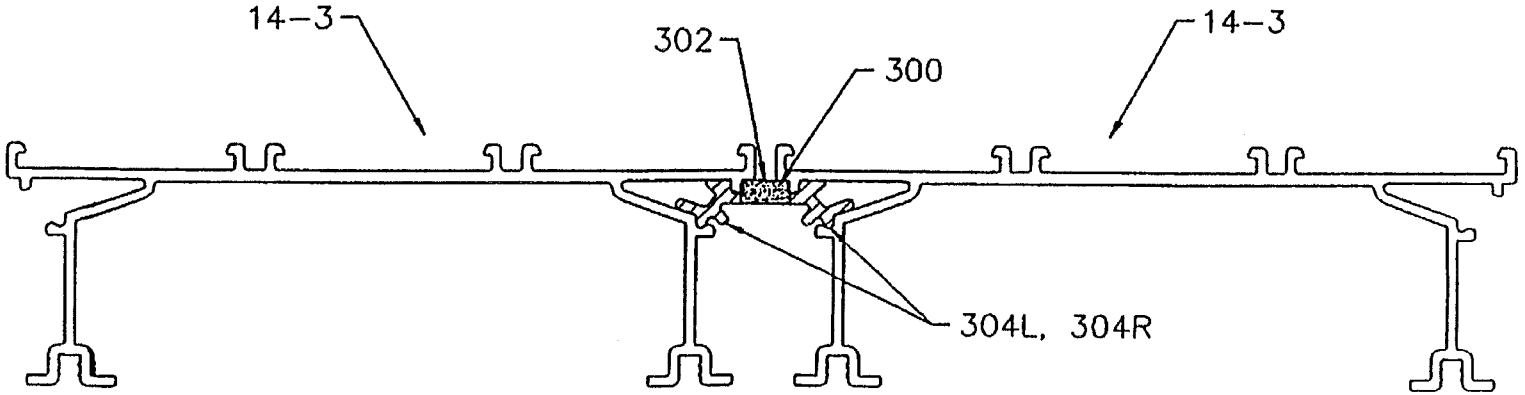
FIG. 22 is an end view of another embodiment of a grille having clips joining the plank members.

The clips 300 of the grille shown in FIG. 22 are geometrically and dimensionally the same as those of FIG. 21. The only difference is that the clips 300 have a semi-rigid body portion 302 and rigid arm portions 304*l* and 304*r*. The semi-rigid body portion 302 allows some movement between adjacent plank members and facilitates compliance with unevenness in the supporting surface and accommodation to a widthwise variance between the size of the grille and the pit in which it is installed. The clips 300 can be made from polymeric materials, using a harder polymer for the arm portions 304*l* and 304*r* and a softer material for the body portion 302.

Instead of short clips 200 or 300, several long clips or a single clip that extends the full length of the adjacent plank members can be used. Long clips or full-length clips may have perforations, if desired, to allow dirt and water to pass through the grille to the pan or floor below.

We claim:

1. A foot grille comprising a multiplicity of elongated plank members, each plank member being of substantially uniform cross-section and including a substantially planar base portion having parallel side edges and an upper surface and at least one supporting leg portion depending from the base portion, the leg portion extending longitudinally substantially coextensively with the base portion and being adapted to support the base portion in spaced relation above a supporting surface, tread members attached to the upper surface of each plank member, and snap-fit couplings joining each adjacent pair of plank members along a coupled joint between adjacent side edges, each snap-fit coupling including integral first and second arm portions on one of the adjacent plank members that are resiliently deformable relative to each other and are joined to the base portion of said one plank member at a common juncture and a third arm portion carried by the other of the adjacent plank members that is received between the first and second arm portions of said one plank member, the first and third arm portions having a first tongue and groove pair in locking engagement at a first engagement point, and the second and third arm portions having a second tongue and groove pair in locking engagement at a second engagement point located generally below the first engagement point and closely spaced apart from the first engagement point, each of the first and second engagement points being spaced apart from the juncture by a distance substantially greater than the spacing between the first and second engagement points and a rigid portion of the third arm bridging the space between the first and second engagement points.

2. A foot grille according to claim 1 wherein the first arm is a part of the base portion adjacent one side edge of one of the adjacent members and the third arm extends generally outwardly from an edge of the base portion of the other one of the adjacent members.

3. A foot grille according to claim 1 wherein one of the supporting leg portions is joined to the second arm portion in spaced apart relation to the juncture.

4. A foot grille according to claim 1 wherein one of the supporting leg portions includes a web portion dependant from the second arm portion at a location spaced part from the juncture and a foot portion on its lower end.

5. A foot grille according to claim 1 wherein one of the supporting leg portions is coincident with a part of the second arm portion and includes a foot portion on its lower end.

6. A foot grille according to claim 1 wherein each plank member has on its upper surface a multiplicity of longitudinally extending laterally spaced-apart ribs arranged in pairs, each rib pair defines a receptacle, each tread member is an elongated strip, each receptacle receives a tread member, and opposite side edges of each tread member engage the ribs defining the receptacle that receives that tread member.

7. A foot grille according to claim 6 wherein the receptacles are closely spaced apart and wherein portions of the base member between the receptacles have holes that allow dirt and water to pass from above the grille through it to the supporting surface.

8. A foot grille according to claim 6 wherein there is a rib substantially at each side edge of each plank member, the receptacles of each plank member of the grille are equally spaced apart, and the receptacles adjacent each edge of each plank member are spaced apart from the receptacle adjacent the adjacent edge of the adjacent plank member by a distance substantially equal to the spacing of the receptacles of each plank member.

9. A foot grille according to claim 1 wherein the third arm portion is integral and substantially coextensive lengthwise with said other of the adjacent plank members.

10. A foot grille according to claim 1 wherein the snap fit couplings joining at least two adjacent plank members are composed of a multiplicity of clip members spaced apart longitudinally at intervals along the lengths of the adjacent plank members, each clip having a third arm portion received between first and second arm portions of each of the adjacent plank members.

11. A foot grille according to claim 10 wherein each clip member is substantially rigid.

12. A foot grille according to claim 10 wherein each clip member has a flexible portion joining the third arm portions.

13. A foot grille comprising a multiplicity of elongated plank members, each plank member being of substantially uniform cross-section and including a substantially planar base portion having parallel side edges and an upper surface and at least one supporting leg portion depending from the base portion, the leg portion extending longitudinally substantially coextensively with the base portion and being adapted to support the base portion in spaced relation above a supporting surface, tread members attached to the upper surface of each plank member, and snap-fit couplings joining each adjacent pair of plank members along a coupled joint between adjacent side edges, each snap-fit coupling including on one of the adjacent plank members a first arm portion constituted by a part of the base portion along one side edge and a second arm portion joined to the base portion at a juncture spaced apart from said one side edge and extending downwardly and laterally from the juncture toward the other of the adjacent plank members, the first and second arm portions being resiliently deformable relative to each other, and on the other of the plank members a third arm portion that is received between the first and second arm portions of said one plank member, the first and third arm portions having a first tongue and groove pair in locking engagement at a first engagement point, and the second and third arm portions having a second tongue and groove pair in locking engagement at a second engagement point located generally below the first engagement point and closely spaced apart from the first engagement point, each of the first and second engagement points being spaced apart from the juncture by a distance substantially greater than the spacing between the first and second engagement points and a rigid portion of the third arm bridging the space between the first and second engagement points.

14. A foot grille according to claim 13, wherein one of said at least one supporting leg portion is joined to the second arm portion in spaced apart relation to the juncture.

15. A foot grille according to claim 13, wherein one of said at least one supporting leg portion includes a web portion dependent from the second arm portion at a location spaced part from the juncture and a foot portion on its lower end.

16. A foot grille according to claim 13, wherein one of said at least one supporting leg portion is coincident with a part of the second arm portion and includes a foot portion on its lower end.

17. A foot grille according to claim 13, wherein the first tongue and groove pair includes a tongue on the first arm and a groove on the third arm, and the third arm has a camming surface adjacent the groove and engageable with the tongue on the first arm adapted to resiliently deflect the first and second arms when the second tongue and groove pair are engaged and the adjacent plank members are pivoted laterally relative to each other with the second engagement point as a fulcrum.

* * * * *